US005975208A

United States Patent [19]

Brooks

[11] Patent Number: 5,975,208

[45] Date of Patent: Nov. 2, 1999

[54] METHOD AND APPARATUS FOR DEPLOYING A WELL TOOL INTO A LATERAL WELLBORE

[75] Inventor: Robert T. Brooks, Grand Prairie, Tex.

[73] Assignee: Dresser Industries, Inc., Dallas, Tex.

[21] Appl. No.: 09/054,365

[22] Filed: Apr. 2, 1998

Related U.S. Application Data

[60] Provisional application No. 60/042,927, Apr. 4, 1997.

[51] Int. Cl.[6] ..... E21B 7/06; E21B 43/14

[52] U.S. Cl. ..... 166/313; 166/50; 166/117.6; 166/242.2

[58] Field of Search ..... 166/50, 117.5, 166/117.6, 242.2, 313; 175/73

[56] References Cited

U.S. PATENT DOCUMENTS

| | | | |
|---|---|---|---|
| 2,271,005 | 1/1942 | Grebe | 166/50 X |
| 2,397,070 | 3/1946 | Zubling . | |
| 2,670,180 | 2/1954 | Ranney | 166/50 X |
| 2,696,264 | 12/1954 | Colmerauer et al. | 166/50 X |
| 2,797,893 | 7/1957 | McCune et al. . | |
| 2,804,926 | 9/1957 | Zublin | 166/50 |
| 2,858,107 | 10/1958 | Colmerauer . | |
| 4,420,049 | 12/1983 | Holbert | 175/45 |
| 5,222,554 | 6/1993 | Blount et al. | 166/117.6 |
| 5,275,240 | 1/1994 | Peterson et al. | 166/242.2 |
| 5,311,936 | 5/1994 | McNair et al. | 166/50 |
| 5,318,121 | 6/1994 | Brockman et al. | 166/313 |
| 5,325,924 | 7/1994 | Bangert et al. | 166/313 |
| 5,388,648 | 2/1995 | Jordan, Jr. | 166/380 |
| 5,396,950 | 3/1995 | Talley et al. | 166/50 |
| 5,425,419 | 6/1995 | Sieber | 166/206 |
| 5,427,177 | 6/1995 | Jordan, Jr. et al. | 166/50 |
| 5,431,219 | 7/1995 | Leising et al. | 166/50 |
| 5,467,819 | 11/1995 | Braddick | 166/117.6 |
| 5,474,131 | 12/1995 | Jordan, Jr. et al. | 166/313 |
| 5,477,925 | 12/1995 | Trahan et al. | 166/382 |
| 5,484,017 | 1/1996 | Coon | 166/117.5 |
| 5,520,252 | 5/1996 | McNair | 166/313 |
| 5,533,573 | 7/1996 | Jordan, Jr. et al. | 166/313 |

(List continued on next page.)

FOREIGN PATENT DOCUMENTS 0 701 040 A2 3/1996 European Pat. Off. .

OTHER PUBLICATIONS

PCT International Search Report for Int'l Application No. PCT/US98/06658 filed on Apr. 3, 1998, Sep. 7, 1998.

PCT International Search Report for Int'l Application No. PCT/US98/06653 filed on Apr. 3, 1998, Sep. 7, 1998.

Schlumberger Horizontal Well—Complete Analysis: Production Logging, DEFT Specifications, Mar. 10, 1997, 2 pages, Mar. 10, 1997.

*Primary Examiner*—George Suchfield

*Attorney, Agent, or Firm*—Konneker & Smith, P.C.; Patrick McCollum

[57] ABSTRACT

A deployment tool for communicating a well tool from a generally vertical wellbore to a lateral wellbore includes a hollow tube having a generally uniform inside diameter. The tube includes at least one flex portion disposed intermediate a first end and a second end of the tube to allow for angular deflection of the second end of the tube with respect to the first end of the tube. The flex portion also maintains the generally uniform inside diameter of the tube during the angular deflection. The deployment tool also includes a locking device attached to the first end of the tube for releasably securing the first end of the tube at a selected location in the vertical wellbore adjacent to the lateral wellbore. The tube of the deployment tool includes a length selected to allow the second end of the tube to extend into a portion of the lateral wellbore when the first end is releasably secured at the selected location in the vertical wellbore.

21 Claims, 6 Drawing Sheets

U.S. PATENT DOCUMENTS

| | | | |
|---|---|---|---|
| 5,535,822 | 7/1996 | Schock et al. | 166/50 |
| 5,564,503 | 10/1996 | Longbottom et al. | 166/313 |
| 5,649,595 | 7/1997 | Davis et al. | 166/297 |
| 5,651,415 | 7/1997 | Scales | 166/250 |
| 5,678,634 | 10/1997 | Rehbock et al. | 166/377 |
| 5,680,901 | 10/1997 | Gardes | 166/313 |
| 5,697,445 | 12/1997 | Graham | 166/313 |
| 5,715,891 | 2/1998 | Graham | 166/313 |
| 5,730,224 | 3/1998 | Williamson et al. | 166/386 |
| 5,806,614 | 9/1998 | Nelson | 175/61 |
| 5,845,707 | 12/1998 | Longbottom | 166/50 |

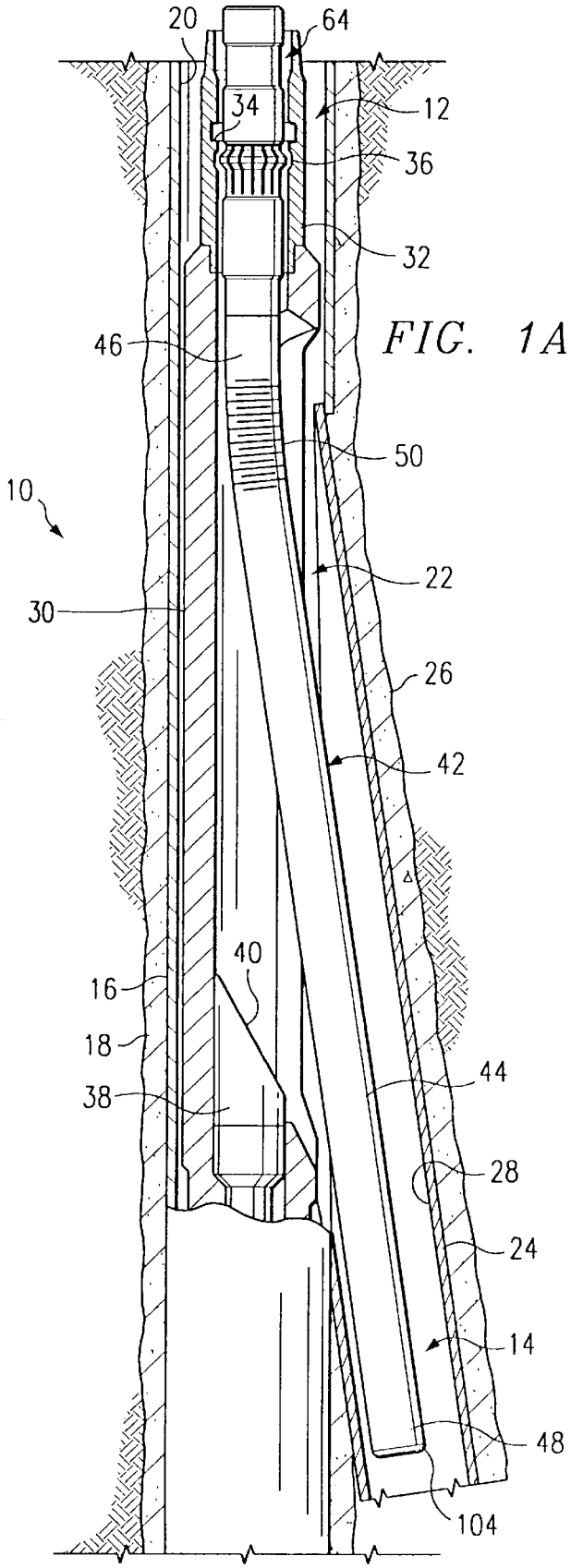
FIG. 1A
FIG. 1B
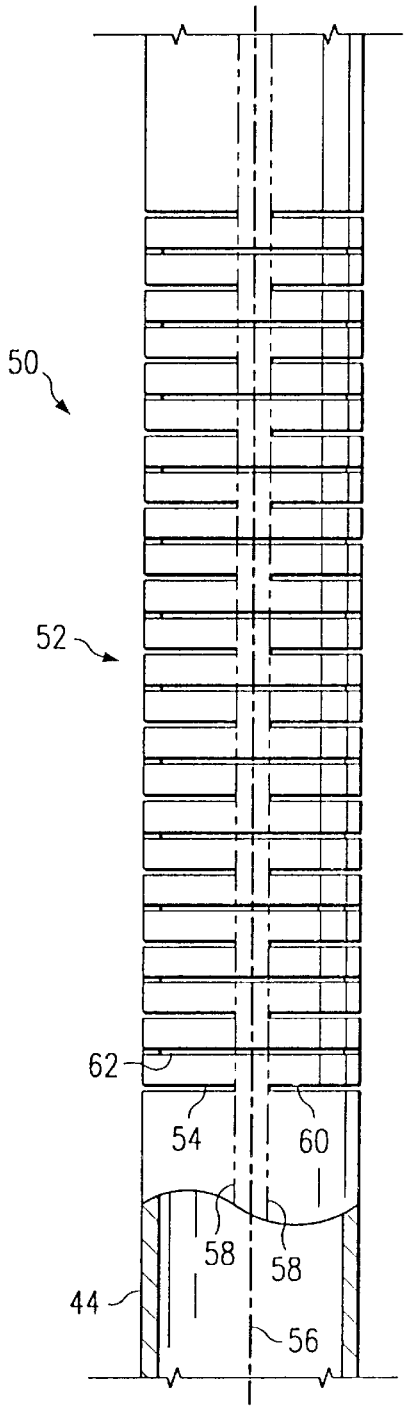

METHOD AND APPARATUS FOR DEPLOYING A WELL TOOL INTO A LATERAL WELLBORE

RELATED APPLICATIONS

This application claims the benefit of U.S. Provisional Application Ser. No. 60/042,927 filed Apr. 4, 1997.

This application is related to patent application Ser. No. 60/042,170 filed Mar. 31, 1997, and entitled Lateral Re-Entry System Window Assembly, now abandoned; patent application Ser. No. 09/054,366 filed Apr. 2, 1999 and entitled Multilateral Whipstock and Tools for Installing and Retrieving which claims priority from U.S. Ser. No. 60/043,902 filed Apr. 4, 1997; and patent application Ser. No. 09/054,367 filed Apr. 2, 1998 and entitled Window Assembly for Multiple Wellbore Completions which claims priority from U.S. Ser. No. 60/042,927 filed Apr. 4, 1997.

TECHNICAL FIELD OF THE INVENTION

The present invention relates generally to equipment for use with a well having a vertical wellbore and at least one lateral wellbore and, more particularly, to a method and apparatus for deploying a well tool into a lateral wellbore.

BACKGROUND OF THE INVENTION

During the past several years, substantial improvements have been made in three dimensional (3D) seismic surveys to better locate and define the boundaries of underground hydrocarbon producing formations. During this same time period, substantial improvements have also been made in directional drilling and horizontal well completion techniques. As a result, many current well completions often include more than one wellbore or borehole. For example, a generally vertical wellbore may be initially drilled adjacent to one or more hydrocarbon producing formations. Multiple wellbores may then be drilled from the vertical wellbore to optimize production from the adjacent hydrocarbon producing formation or formations. Such well completions are often referred to as multilateral wells.

A typical multilateral well completion will include a generally vertical or primary wellbore defined in part by a casing string and a layer of cement disposed between the exterior of the casing string and the inside diameter of the primary wellbore. Directional drilling equipment and techniques may be used to form an exit or window in the casing string and layer of cement at a downhole location selected for drilling a lateral or secondary wellbore from the primary wellbore. Directional drilling equipment and techniques may also be used to drill the lateral or secondary wellbore from the primary wellbore.

The location of the exit or window from the primary wellbore, the orientation of the window, the length of the secondary wellbore and the orientation of the secondary wellbore relative to the primary wellbore are selected based on the characteristics of the associated hydrocarbon producing formation. For many locations such as deep offshore wells, multiple lateral wellbores will be drilled from each vertical wellbore in an effort to optimize hydrocarbon production while minimizing drilling costs. Selective isolation and/or reentry into each of the secondary wellbores is often necessary to further optimize production from the associated hydrocarbon producing formations.

The process of drilling and using lateral wellbores, however, suffers several disadvantages. For example, equipment such as drilling and logging devices must transition to and from the lateral wellbore without becoming lodged at an intersection of the primary wellbore and the lateral wellbore. For instance, one example of a logging tool used to analyze material surrounding a wellbore includes four arms with springs, called bow spring centralizers. The bow spring centralizers expand within the wellbore to centralize the logging tool within a wellbore. During insertion or retrieval of the logging tool, however, the bow spring centralizers may become lodged or broken at the intersection of the primary wellbore and the lateral wellbore.

SUMMARY OF THE INVENTION

Accordingly, a need has arisen for an apparatus and method for communicating a well tool between a primary wellbore and a lateral wellbore.

In accordance with the teachings of the present invention, an apparatus and method for communicating a well tool between a primary wellbore and a lateral wellbore are provided that address disadvantages and problems associated with prior art systems and methods. According to one embodiment of the present invention, a deployment tool for communicating a well tool between a first wellbore and a second wellbore extending therefrom comprises a hollow tube having a generally uniform inside diameter. The tube includes a first end, a second end, and at least one flex portion disposed intermediate the first end and second end of the tube. The flex portion allows for angular deflection of the second end of the tube with respect to the first end of the tube. The flex portion also maintains the generally uniform inside diameter of the tube during the angular deflection. The deployment tool also includes a locking device attached to the first end of the tube for releasably securing the first end of the tube at a selected location in the first wellbore adjacent to the second wellbore. The tube preferably has a length selected to allow the second end of the tube to extend into a portion of the second wellbore when the first end of the tube is releasably secured at the selected location in the first wellbore.

According to another embodiment of the invention, a method for communicating a well tool between a generally vertical wellbore and a lateral wellbore extending therefrom comprises fabricating and providing a deployment tool. The method of fabricating the deployment tool comprises providing a hollow tube having a generally uniform inside diameter and including a first end and a second end. At least one flex portion is formed intermediate the first end and second end of the tube to allow angular deflection of the second end with respect to the first end. The flex portion maintains the generally uniform inside diameter of the tube during the angular displacement. The method for providing the deployment tool also includes a mechanical connection for attaching a locking device to the first end of the tube to releasably secure the first end of the tube at a selected location in the vertical wellbore adjacent to the lateral wellbore. The method for communicating a well tool between a vertical wellbore and a lateral wellbore further includes running the deployment tool down the vertical wellbore, deflecting the second end of the deployment tool into the lateral wellbore, and engaging the locking device to releasably secure the first end of the deployment tool at the selected location in the vertical wellbore. The method of communicating a well tool further includes running the well tool down the vertical wellbore, through the deployment tool, and into the lateral wellbore.

Embodiments of the invention provide several technical advantages. For example, one embodiment of the invention provides a deployment tool that provides an easier transition for well tools from a first wellbore to a second wellbore than conventional multilateral well systems. Multiple flex portions may be formed in or attached to a deployment tool in accordance with teachings of the present invention to accommodate a wide variety of angles and/or radius of bending at which a second wellbore intersects a first wellbore. Also, an embodiment of the invention provides a deployment tool that facilitates retrieval of logging equipment and downhole service tools from the second wellbore. Other technical advantages are readily apparent to one skilled in the art from the following figures, descriptions, and the claims.

BRIEF DESCRIPTION OF THE DRAWINGS

For a more complete understanding of the present invention and its advantages, reference is now made to the following brief description, taken in conjunction with the accompanying drawings and detailed description, wherein like reference numerals represent like parts, in which:

FIG. 1A is a schematic drawing in section and in elevation showing a well completion having a first wellbore with a second wellbore extending therefrom and a deployment tool incorporating teachings of the present invention disposed in the first wellbore and the second wellbore;

FIG. 1B is a schematic drawing with portions broken away showing an embodiment of a flex portion of the deployment tool shown in FIG. 1A incorporating teachings of the present invention;

DETAILED DESCRIPTION OF THE INVENTION

Figure 2:
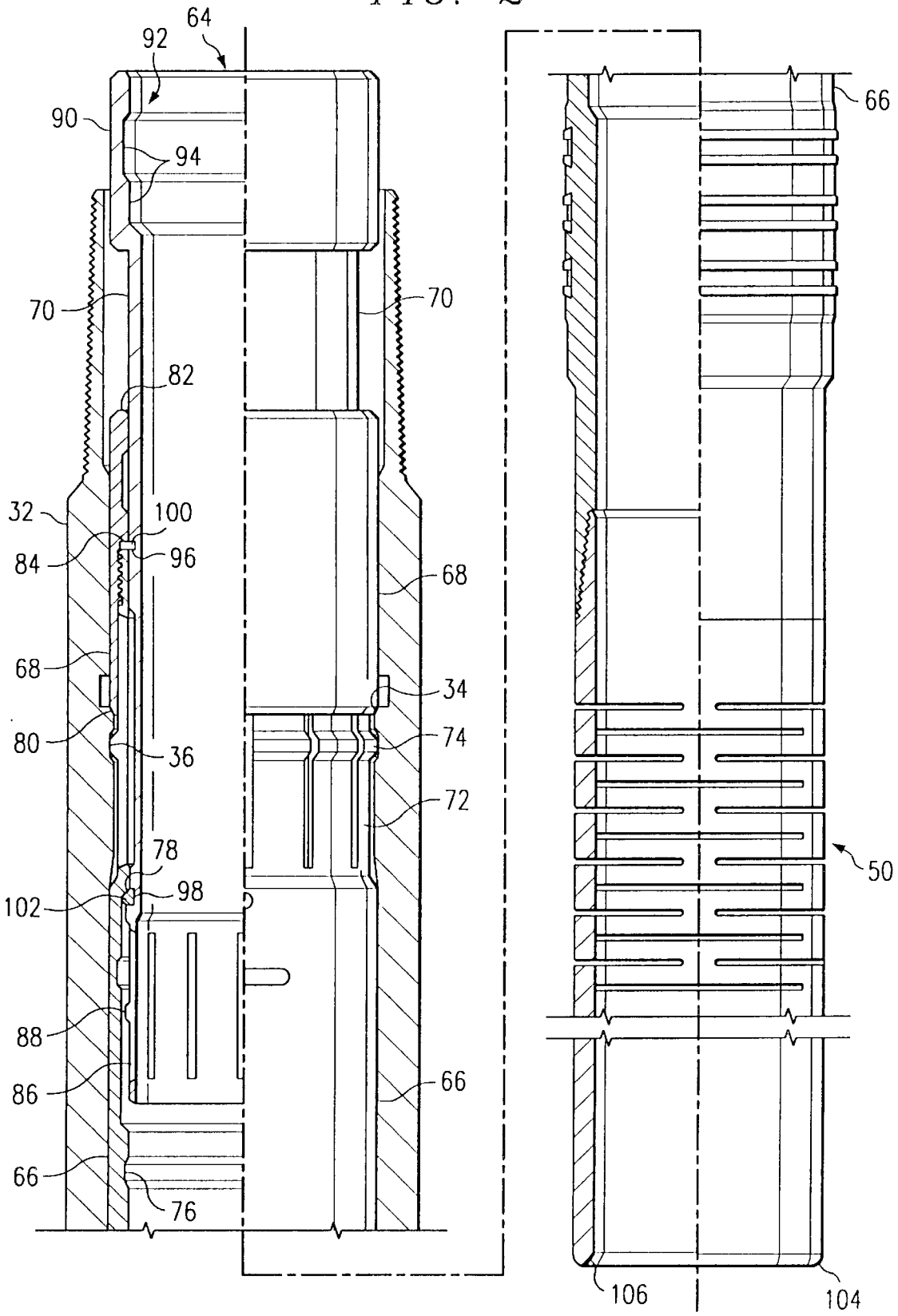
FIG. 2 is a schematic drawing in section and in elevation with portions broken away showing a deployment tool incorporating teachings of the present invention including a locking device.

The preferred embodiments of the present invention and its advantages are best understood by referring now in more detail to FIGS. 1A through 6 of the drawings, in which like numerals refer to like parts.

FIG. 1A is a schematic drawing showing a portion of well 10 which includes a first wellbore 12 and a second wellbore 14. For the embodiment shown in FIG. 1A, first wellbore 12 has a generally vertical configuration. Second wellbore 14 intersects first wellbore 12 at a relatively shallow angle of approximately 4° or 5° as measured relative to a longitudinal center line of first wellbore 12. Current directional drilling and horizontal well completion techniques allow forming second wellbore 14 with the optimum angle and radius relative to first wellbore 12 to optimize production from an adjacent hydrocarbon producing formation (not explicitly shown) while also minimizing the cost of drilling first wellbore 12 and second wellbore 14. For some applications, well 10 may include multiple wellbores extending radially from first wellbore 12. If well 10 includes more than one second wellbore 14, well 10 would often be referred to as a "multilateral well completion."

First wellbore 12 includes casing string 16 with a layer of cement 18 disposed between the exterior of casing string 16 and an inside diameter or wall 20 of first wellbore 12. Conventional directional drilling techniques may be used to form a window 22 in casing string 16 and layer of cement 18 to form second wellbore 14.

Second wellbore 14 includes a liner 24 and a layer of cement 26 disposed between an exterior surface of liner 24 and an inside diameter or wall 28 of second wellbore 14. For some applications, second wellbore 14 may be an "open hole completion" without liner 24 or any cement 26 disposed therein. Various types of well completion techniques and equipment may be used to form first wellbore 12 and second wellbore 14 depending upon the characteristics associated with the adjacent hydrocarbon producing formation.

A tubing string (not explicitly shown) may be installed within casing string 16 extending from the well surface to a desired downhole location in first wellbore 12. A window assembly 30 may be connected as an integral part of the associated tubing sting and disposed adjacent to each window 22 in casing string 16. Landing nipple 32 may also be provided at one end of window assembly 30. Landing nipple 32 may include an inwardly facing circumferential shoulder 34 and an inwardly facing circumferential groove 36. As will be discussed in greater detail below, landing nipple 32 may be used to prevent further downward travel of tools within first wellbore 12.

Whipstock assembly 38 including an angled or tapered face 40 may be provided adjacent window 22 in casing string 16. Tapered face 40 of whipstock assembly 38 provides a deflecting surface to deflect various types of logging equipment and downhole well servicing tools into second wellbore 14. Deployment tool 42 incorporating teachings of the present invention is shown in FIG. 1A deflected into second wellbore 14.

Deployment tool 42 includes a hollow tube 44 having a generally uniform inside diameter. Hollow tube 44 also includes a first end 46 and a second end 48. Deployment tool 42 also includes flex portion 50 located intermediate first end 46 and second end 48 of hollow tube 44. Flex portion 50 of deployment tool 42 allows for angular deflection of second end 48 of hollow tube 44 with respect to first end 46 of hollow tube 44. Additionally, flex portion 50 allows, second end 48 of deployment tool 42 to deflect into second wellbore 14 while maintaining the generally uniform inside diameter of hollow tube 44 during the angular deflection.

FIG. 1B is a schematic drawing with portions broken away of an embodiment of flex portion 50 of deployment tool 42 shown in FIG. 1A including a plurality of slots 52. Slots 52 may be integrally formed in hollow tube 44 by forming a first slot 54 in hollow tube 44 perpendicular to a longitudinal axis 56 of hollow tube 44. First slot 54 may be formed to a predetermined depth 58 measured radially inward from the exterior surface of hollow tube 44. A second slot 60 may be integrally formed opposite first slot 54 and perpendicular to longitudinal axis 56 of hollow tube 44 to predetermined depth 58.

A third slot 62 may also be integrally formed in hollow tube 44 perpendicular to longitudinal axis 56 and longitudinally spaced apart from first slot 54 and second slot 60. Additionally, third slot 62 may be disposed at an angle of approximately 90° from first slot 54 and second slot 60;

however, third slot 62 may be disposed at other suitable angles and orientations relative to first slot 54 and second slot 60 to provide desired angular deflection of second end 48 of hollow tube 44 with respect to first end 46 of hollow tube 44. A fourth slot (not explicitly shown) may also be integrally formed in hollow tube 44 perpendicular to longitudinal axis 56 and opposite third slot 62 to predetermined depth 58. The above-described pattern of slots 52 may be repeated along hollow tube 44 to a desired length.

Thus, referring back to FIG. 1A, flex portion 50 allows second end of deployment tool 42 to deflect into second wellbore 14 while maintaining the generally uniform inside diameter of hollow tube 44. Maintaining the generally uniform inside diameter of hollow tube 44 allows for easier communication of well tools from first wellbore 12 to second wellbore 14 than conventional lateral wellbore systems. Additionally, the quantity of, width of, length of and spacing between slots 52 formed in hollow tube 44 may be increased or decreased to modify the amount of angular deflection between first end 46 and second end 48 of hollow tube 44. Although the embodiment of flex portion 50 described above includes slots 52, it will be recognized that other suitable methods of providing angular deflection of first end 46 with respect to second end 48 of hollow tube 44 may be used while maintaining the generally uniform inside diameter of hollow tube 44 during the angular deflection.

For some applications, deployment tool 42 preferably includes a locking device 64 attached to first end 46 of hollow tube 44 for releasably securing first end 46 of hollow tube 44 at a selected location in first wellbore 12. The overall length of hollow tube 44 is preferably selected to allow second end 48 of hollow tube 44 to extend into second wellbore 14 when first end 46 of hollow tube 44 is releasably secured using locking device 64 at the selected location in the first wellbore 12.

Figure 3:
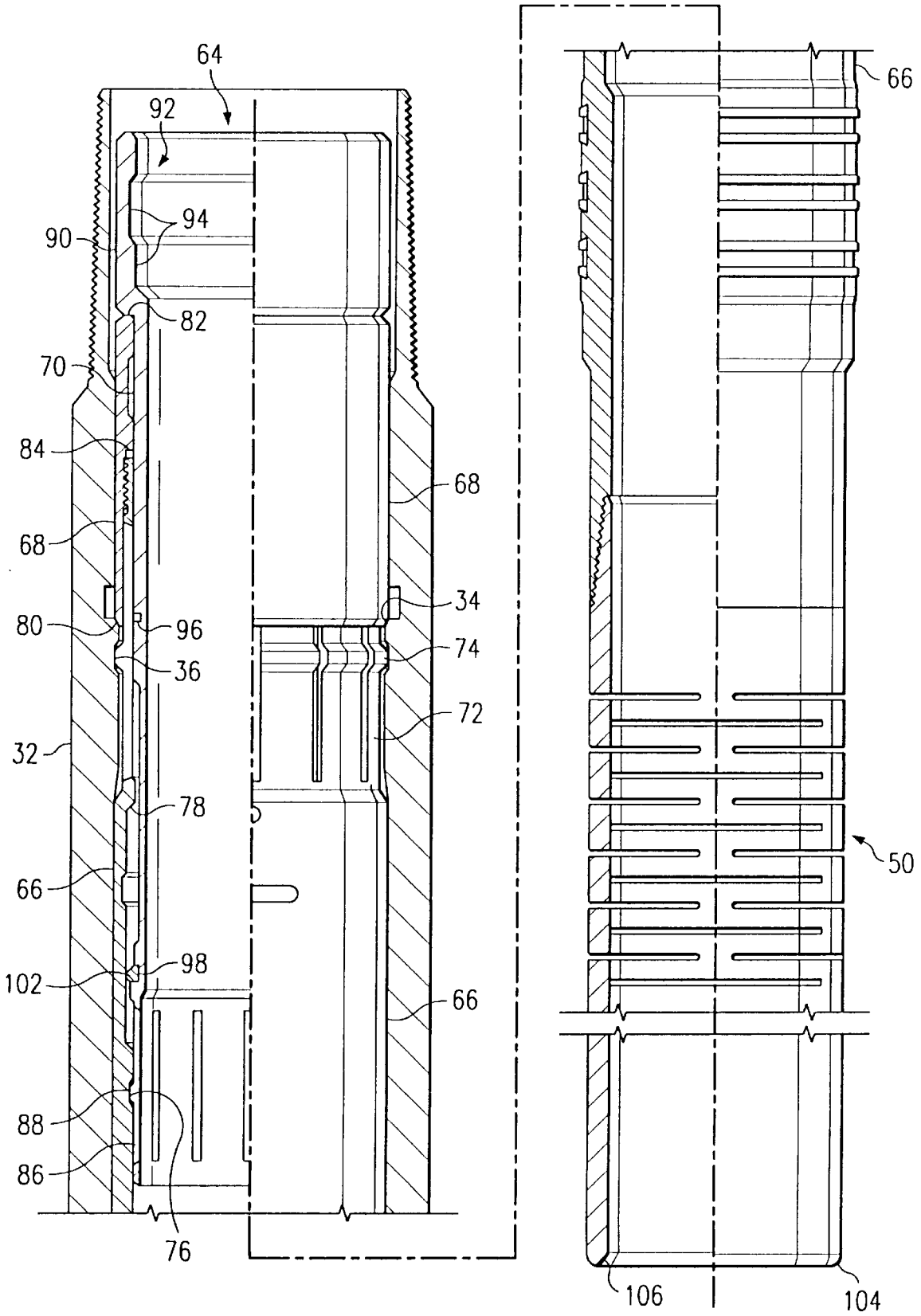
FIG. 3 is a schematic drawing in section and in elevation with portions broken away showing the deployment tool of FIG. 2 after engaging the locking device.

FIG. 2 is a schematic drawing in section and in elevation with portions broken away of deployment tool 42 prior to engaging locking device 64 within first wellbore 12, and FIG. 3 is a schematic drawing in section and in elevation with portions broken away of deployment tool 42 after engaging locking device 64 within first wellbore 12. For this embodiment of the invention, locking device 64 includes a locking body 66, a no-go sleeve 68, and a fishing tube 70.

Locking body 66 of locking device 64 includes a plurality of main collet fingers 72, the main collet fingers 72 being flexible allowing limited radial movement. Each of main collet fingers 72 also includes a bevel surface or collet head 74 extending radially outward therefrom. Locking body 66 also includes an inwardly facing circumferential locking groove 76 and an inwardly facing circumferential shoulder 78.

No-go sleeve 68 of locking device 64 includes a lower no-go shoulder 80 and an upper no-go shoulder 82. No-go sleeve 68 also includes an inwardly facing circumferential shoulder 84 disposed intermediate no-go shoulder 80 and no-go shoulder 82.

Fishing tube 70 of locking device 64 includes a snap-latch collet 86 including a plurality of bevel surfaces 88 extending radially outward therefrom. Fishing tube 70 also includes a fishing tube shoulder 90 disposed opposite snap-latch collet 86 of fishing tube 70. Fishing tube shoulder 90 of fishing tube 70 includes a fishing profile 92 formed from a plurality of inwardly facing circumferential grooves 94. Fishing profile 92 may be used for running deployment tool 42 into or retrieving deployment tool 42 from first wellbore 12 and second wellbore 14. The method of retrieving deployment tool 42 shall be discussed below in greater detail. Fishing tube 70 also includes an outwardly facing circumferential shear plate groove 96 and an outwardly facing circumferential snap ring groove 98.

The operation of the above-described embodiment will now be briefly described. No-go sleeve 68, locking body 66, and fishing tube 70 initially have the relationship shown in FIG. 2. An annular shear plate 100 is disposed in shoulder 84 of no-go sleeve 68 and cooperates with shear plate groove 96 of fishing tube 70. When no-go sleeve 68 is secured to locking body 66, shear plate 100 operates to secure together no-go sleeve 68, fishing tube 70, and locking body 66. An annular snap ring 102 is disposed in snap ring groove 98 of fishing tube 70 and cooperates with shoulder 78 of locking body 66. Snap ring 102 will be further discussed below during retrieval of deployment tool 42 from first wellbore 12 and second wellbore 14.

A wireline or coiled tubing string (not explicitly shown) may be secured to fishing profile 92 of fishing tube 70 using grooves 94 and a downward force applied to fishing tube 70 to run deployment tool 42 from the well surface through first wellbore 12. Continued downward force applied to fishing tube 70 is transmitted through shear plate 100 to locking body 66, thereby deflecting second end 48 of deployment tool 42 into second wellbore 14 as deployment tool 42 travels downward. As shown best in FIG. 1A, second end 48 of deployment tool 42 deflects off of tapered face 40 of whipstock assembly 38 and through window 22 into second wellbore 14.

Deployment tool 42 may be run through first wellbore 12 to landing nipple 32 of window assembly 30 until no-go shoulder 80 of no-go sleeve 68 reaches landing nipple 32 as shown in FIG. 1A. As deployment tool 42 is moved longitudinally into landing nipple 32, main collet fingers 72 of locking body 66 are urged radially inward within landing nipple 32. When no-go shoulder 80 of no-go sleeve 68 reaches landing nipple 32, bevel surfaces 74 of main collet fingers 72 reach and cooperate with groove 36 of landing nipple 32. As discussed further below, bevel surfaces 74 of main collet fingers 72 cooperate with groove 36 of landing nipple 32 to secure locking body 66 and no-go sleeve 68 in landing nipple 32 within first wellbore 12.

When no-go shoulder 80 of no-go sleeve 68 reaches landing nipple 32, locking body 66 and no-go sleeve 68 are prevented from further downward travel within first wellbore 12. Further downward force may be applied to fishing tube 70 to shear or break shear plate 100 allowing fishing tube 70 to travel downward within locking body 66. Additionally, downward travel of fishing tube 70 within locking body 66 prevents inward radial movement of main collet fingers 72 of locking body 66. Thus, bevel surfaces 74 of main collet fingers 72 are prevented from disassociating from groove 36 of landing nipple 32, thereby securing first end 46 of deployment tool 42 in first wellbore 12.

As shown best in FIG. 3, fishing tube 70 travels downward within locking body 66 until bevel surfaces 88 of snap-latch collet 86 reach locking groove 76 of locking body 66. Additionally, fishing tube shoulder 90 of fishing tube 70 travels downwardly until reaching upper no-go shoulder 82 of no-go sleeve 68. Bevel surfaces 88 of snap-latch collet 86 cooperate with locking groove 76 of locking body 66 to secure deployment tool 42 in first wellbore 12. The wireline or coiled tubing string may be released from deployment tool 42 and removed from first wellbore 12.

As best shown in FIG. 2, second end 48 of deployment tool 42 also includes a spherical end portion 104 for allowing easier deflection of second end 48 of deployment tool 42 off of tapered face 40 of whipstock assembly 38 and into second wellbore 14. However, second end 48 may include other suitable shapes or configurations, such as a taper or chamfer (not explicitly shown), allowing for easier deflection into second wellbore 14. Second end 48 of deployment tool 42 also includes an inwardly facing circumferential bevel portion 106. Bevel portion 106 allows for easier retrieval of logging equipment and other downhole well service tools from second wellbore 14. For example, logging equipment may be run through first wellbore 12 and deployment tool 42 into second wellbore 14. An example of such equipment may include a logging device (not explicitly shown) used to analyze characteristics of a formation surrounding second wellbore 14. The logging device may include a plurality of arms with bow springs, called bow spring centralizers, for centralizing the logging tool within second wellbore 14. When the logging tool exits second end 48 of deployment tool 42, the bow spring centralizers expand to centralize the logging tool within second wellbore 14. During retrieval of the logging tool, upward force is applied to the logging tool to pull the logging tool through deployment tool 42 and into first wellbore 12. Bevel portion 106 of deployment tool 42 allows the bow spring centralizers to retract providing easier transition of the logging tool into deployment tool 42 and into first wellbore 12, thereby preventing the logging tool from becoming broken or lodged within second wellbore 14.

Deployment tool 42 may also be retrieved from first wellbore 12 and second wellbore 14. A running/retrieval tool (not explicitly shown) may be run downwardly into first wellbore 12 until the running/retrieval tool reaches fishing tube 70. The running/retrieval tool may cooperate with fishing profile 92 using grooves 94 to secure the running/retrieval tool to fishing tube 70. An upward force may be applied to the running/retrieval tool thereby causing bevel surfaces 88 of snap-latch collet 86 to disassociate from locking groove 76 of locking body 66. As fishing tube 70 travels upwardly within locking body 66, main collet fingers 72 of locking body 66 become inwardly unsupported by fishing tube 70.

As upward force continues, fishing tube 70 travels upwardly within locking body 66 until snap ring 102 reaches shoulder 78 of locking body 66. Once snap ring 102 reaches shoulder 78 of locking body 66, the upward force applied to fishing tube 70 is transferred to locking body 66 through snap ring 102 and shoulder 78, thereby causing bevel surfaces 74 of main collet fingers 72 to disassociate from groove 36 of landing nipple 32, and thereby allowing deployment tool 42 to travel upward and out of first wellbore 12.

Although locking device 64 of deployment tool 42 has been described above in great detail, it is understood that other methods and devices for locking first end 46 of deployment tool 42 within first wellbore 12 may be used.

Figure 4:
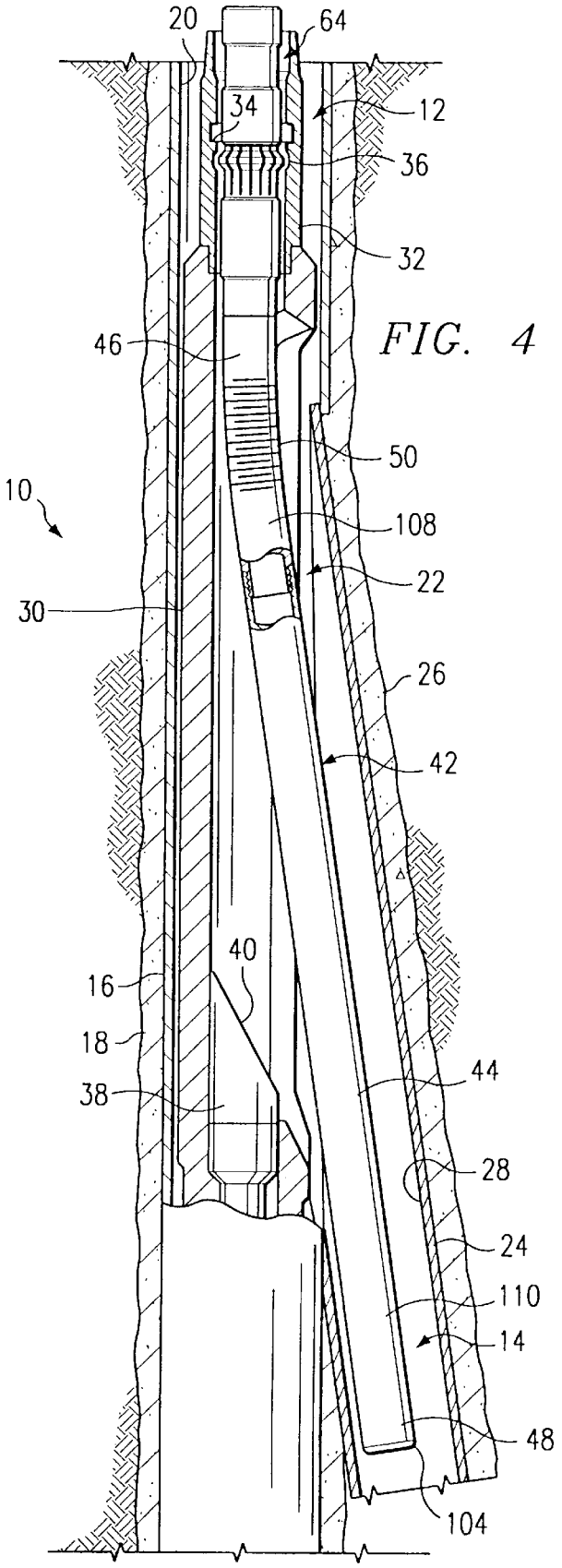
FIG. 4 is a schematic drawing in elevation with portions broken away of an alternate embodiment of a deployment tool incorporating teachings of the present invention.

FIG. 4 is a schematic drawing in elevation illustrating an alternate embodiment of the present invention. In this embodiment, hollow tube 44 includes a first section 108 and a second section 110. First section 108 of deployment tool 42 includes first end 46 and second section 110 of deployment tool 42 includes second end 48. Flex portion 50 of deployment tool 42 may be formed as an integral component of first section 108 of deployment tool 42.

According to the above-described embodiment of the present invention, a length of deployment tool 42 may be increased or decreased by altering a length of second section 110. Additionally, second section 110 of deployment tool 42 may be discarded and replaced if damaged. Therefore, deployment tool 42 provides greater flexibility than conventional lateral wellbore systems.

Figure 5:
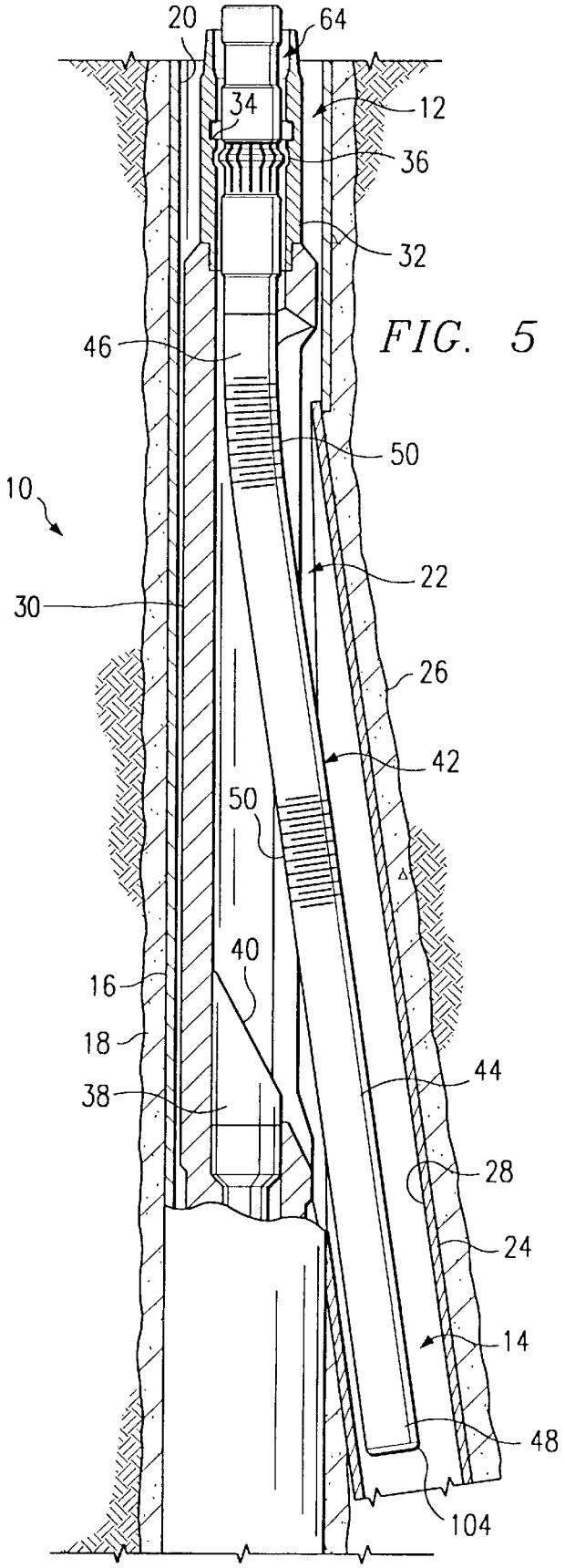
FIG. 5 is a schematic drawing in elevation with portions broken away of an alternate embodiment of a deployment tool incorporating teachings of the present invention.

FIG. 5 is a schematic drawing in elevation illustrating an alternate embodiment of the present invention. In this embodiment, deployment tool 42 includes multiple flex portions 50 formed in hollow tube 44.

Therefore, according to the above-described embodiment, multiple flex portions 50 formed in hollow tube 44 of deployment tool 42 provide increased deflection design of deployment tool 42. For example, the angle of second wellbore 14 relative to first wellbore 12 may require greater deflection of second end 48 with respect to first end 46 of deployment tool 42 based on the characteristics of the adjacent hydrocarbon producing formation. Multiple flex portions 50 may be formed at predetermined locations along hollow tube 44 of deployment tool 42 to provide a desired deflection while maintaining the generally uniform inside diameter of hollow tube 44. Thus, deployment tool 42 may be used to optimize access to the adjacent hydrocarbon producing formation.

Figure 6:
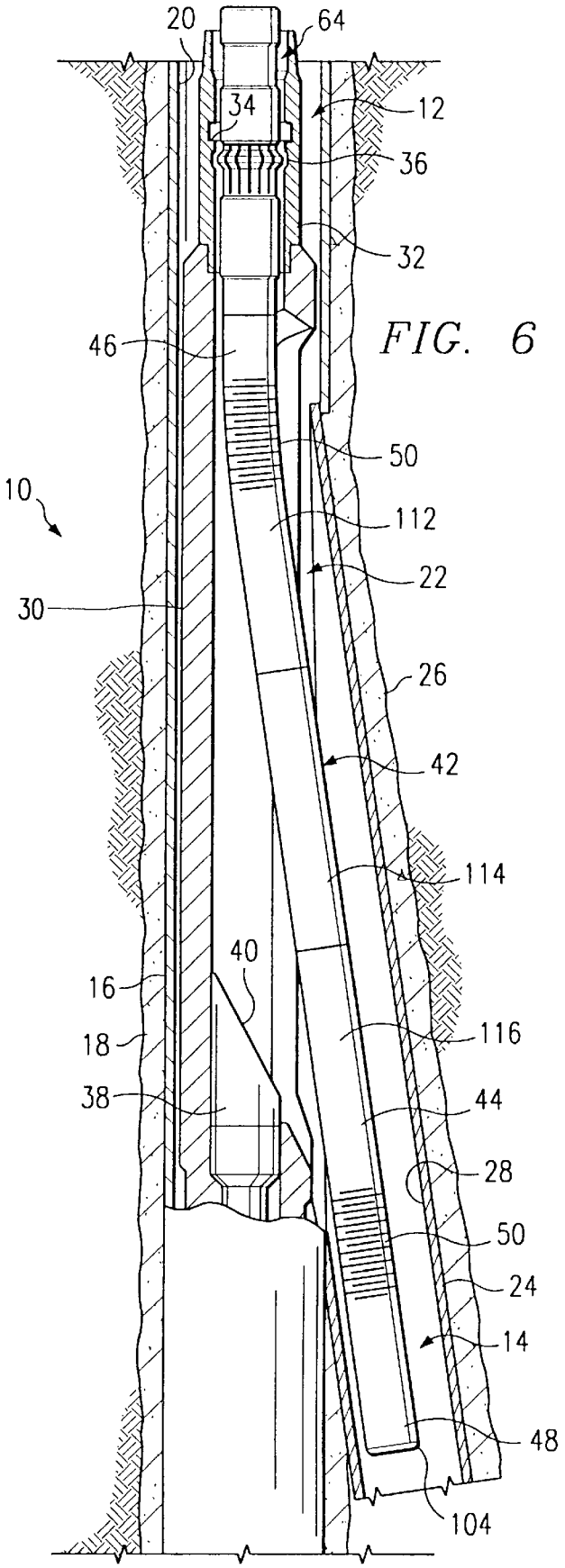
FIG. 6 is a schematic drawing in elevation with portions broken away of an alternate embodiment of a deployment tool incorporating teachings of the present invention.

FIG. 6 is a schematic drawing in elevation illustrating an alternate embodiment of the present invention. In this embodiment, hollow tube 44 includes a first section 112, a second section 114, and a third section 116. First section 112 of hollow tube 44 includes first end 46 and third section 116 of hollow tube 44 includes second end 48. First section 112 of hollow tube 44 and third section 116 of hollow tube 44 include flex portions 50.

Thus, according to this embodiment of the present invention, deployment tool 42 may be constructed to provide for multiple length and deflection configurations to meet the requirements of accessing adjacent hydrocarbon producing formations.

Although the present invention has been described by several embodiments, various changes and modifications may be suggested to one skilled in the art. It is intended that the present invention encompasses such changes and modifications as fall within the scope of the present appended claims.

What is claimed is:

1. A deployment tool for communicating a well tool between a main wellbore and a branch wellbore extending therefrom, the deployment tool comprising:

a tube having a first end and a second end;

at least one flex portion disposed intermediate the first end and second end to allow for angular deflection of the second end with respect to the first end;

a locking device attached to the first end of the tube including means for releasably securing the first end of the tube at a selected location in the main wellbore; and the tube having a length selected to allow the second end to extend into a portion of the branch wellbore when the first end is releasably secured at the selected location in the main wellbore.

2. The deployment tool of claim 1, wherein the flex portion comprises a plurality of slots integrally formed in the tube.

3. The deployment tool of claim 1, wherein the flex portion comprises:

a first slot formed in an exterior surface of the tube; and a second slot formed in the exterior surface of the tube opposite the first slot.

4. The tool of claim 3, wherein the flex portion further comprises a third slot formed in the exterior surface of the tube, the third slot longitudinally spaced apart from the first slot and second slot and disposed at an angle between 0° and 180° from the first slot and the second slot.

5. The deployment tool of claim 1, wherein the tube further comprises a plurality of flex portions.

6. The deployment tool of claim 1, wherein the second end of the tube comprises an interior annular bevel portion.

7. The deployment tool of claim 1, wherein the second end of the tube comprises a generally spherical end portion.

8. The deployment tool of claim 1, wherein the tube further comprises:

a first section and a second section with the second section attached to the first section;

the first end formed on the first section of the tube and the second end formed on the second section of the tube; and the flex portion formed as an integral component of the first section.

9. The deployment tool of claim 1, wherein the tube further comprises:

a first section, a second section, and a third section, with the first section attached to the second section and the second section attached to the third section;

the first end formed on the first section and the second end formed on the third section;

a first flex portion formed as an integral component of the first section; and a second flex portion formed as an integral component of the third section.

10. A method for communicating a well tool between a generally vertical wellbore and a lateral wellbore extending therefrom, the method comprising:

providing a deployment tool fabricated by a method comprising:

providing a hollow tube having a generally uniform inside diameter, the tube having a first end a second end;

disposing a flex portion intermediate the first end and second end to allow for angular deflection of the second end with respect to the first end, the flex portion maintaining the generally uniform inside diameter during the angular displacement; and attaching a locking device to the first end of the tube for releasably securing the first end of the tube at a selected location in the first wellbore adjacent to the lateral wellbore;

running the deployment tool down the vertical wellbore;

deflecting the second end of the deployment tool into the lateral wellbore;

engaging the locking device to releasably secure the first end of the deployment tool at the selected location in the vertical wellbore; and running the well tool down the vertical wellbore, through the deployment tool and into the lateral wellbore.

11. The method of claim 10, wherein the step of disposing a flex portion comprises integrally forming a plurality of slots in the tube.

12. The method of claim 10, wherein the step of disposing a flex portion comprises:

integrally forming a first slot in the tube; and integrally forming a second slot in the tube opposite the first slot.

13. The method of claim 12, and further comprising integrally forming a third slot in the tube, spacing the third slot longitudinally apart from the first slot and second slot, and disposing the third slot at an angle between 0° and 180° from the first slot and the second slot.

14. The method of claim 10, wherein the step of disposing a flex portion further comprises disposing a plurality of flex portions.

15. The method of claim 10, wherein the step of providing a hollow tube further comprises:

providing a hollow tube having a first section and a second section with the second section attached to the first section, and with the first end formed on the first section and the second end formed on the second section; and wherein the step of disposing a flex portion further comprises integrally forming the flex portion as an integral component of the first section.

16. The method of claim 10, wherein the step of fabricating a deployment tool further comprises forming an interior annular bevel portion on the second end of the tube.

17. The method of claim 10, wherein the step of fabricating a deployment tool further comprises forming a generally spherical end portion on the second end of the tube.

18. The method of claim 10, wherein the step of providing a hollow tube further comprises:

providing a hollow tube having a first section, a second section, and a third section, with the first section attached to the second section and the second section attached to the third section, and with the first end formed on the first section and the second end formed on the third section; and wherein the step of disposing a flex portion further comprises:

integrally forming a first flex portion as an integral component of the first section; and integrally forming a second flex portion as an integral component of the third section.

19. A deployment tool for communicating a well tool between a first wellbore and a second wellbore connected to and extending at an angle from the first wellbore, the deployment tool comprising:

a tube having a first end and a second end;

at least one flex portion disposed intermediate the first end and second end to allow for angular deflection of the second end with respect to the first end;

a locking device attached to the first end of the tube including means for releasably securing the first end of the tube at a selected location in the first wellbore; and the tube having a length selected to allow the second end to extend into a portion of the second wellbore when the first end is releasably secured at the selected location in the first wellbore.

20. The deployment tool of claim 19 further comprising:

the tube having a generally uniform outside diameter, a longitudinal axis extending therethrough;

the flex portion having a plurality of slots with each slot extending radially through a portion of the exterior surface and the interior surface of the tube.

21. The deployment tool of claim 20 further comprising each slot aligned at an angle of approximately ninety degrees relative to the longitudinal axis.

* * * * *